US005455480A

United States Patent [19]

Bastian et al.

[11] Patent Number: 5,455,480

[45] Date of Patent: Oct. 3, 1995

[54] HIGH-PRESSURE DISCHARGE LAMP WITH CERAMIC DISCHARGE VESSEL AND CERAMIC SEALING MEANS HAVING LEAD-THROUGH COMPRISING THIN WIRES HAVING A THERMAL COEFFICIENT OF EXPANSION SUBSTANTIALLY LESS THAN THAT OF THE CERAMIC SEALING MEANS

[75] Inventors: Hartmuth Bastian, Feuchtwangen; Stefan Juengst, Zorneding; Peter Wahrendorff, Munich, all of Germany

[73] Assignee: Patent-Treuhand-Gesellschaft F. Elektrische Gluehlampen mbH, Munich, Germany

[21] Appl. No.: 163,686

[22] Filed: Dec. 6, 1993

[30] Foreign Application Priority Data

Dec. 14, 1992 [DE] Germany ..... 42 42 123.3

[51] Int. Cl.[6] ..... H01J 1/96; H01J 19/50; H01J 17/18; H01J 61/36

[52] U.S. Cl. ..... 313/285; 313/289; 313/573; 313/623; 313/625; 313/634; 313/636; 313/638

[58] Field of Search ..... 313/285, 289, 313/571–573, 623, 625, 626, 636, 634, 638, 639

[56] References Cited

U.S. PATENT DOCUMENTS

| | | | |
|---|---|---|---|
| 2,241,505 | 5/1941 | Cuttler | 313/639 |
| 3,848,151 | 11/1974 | McVey | 313/625 |
| 4,011,480 | 3/1977 | Jacobs et al. | 313/625 |
| 4,376,905 | 3/1983 | Kerekes | 313/601 |
| 4,717,852 | 1/1988 | Dobrusskin et al. | 313/25 |
| 4,837,477 | 6/1989 | Dassler et al. | 313/25 |
| 5,075,587 | 12/1991 | Pabst et al. | 313/25 |

FOREIGN PATENT DOCUMENTS

| | | | |
|---|---|---|---|
| 0360617 | 1/1981 | Austria . | |
| 0142202 | 5/1983 | European Pat. Off. . | |
| 2318062 | 11/1973 | Germany . | |
| 2445108 | 5/1975 | Germany . | |
| 63-308861 | 12/1988 | Japan | 313/623 |
| 2-86405 | 3/1990 | Japan | 313/623 |
| 2132750 | 5/1990 | Japan | 313/623 |

OTHER PUBLICATIONS

Patent Abstract of Japan, Unexamined Applications, E. Field, Band 8, No. 123, Jun. 8, 1984, The Patent Office Japanese Government, Seite 70 E 249; & JP–A–59 35 352 (Mitsubishi).

*Primary Examiner*—Anita Pellman Gross
*Assistant Examiner*—Walter J. Malinowski
*Attorney, Agent, or Firm*—Frishauf, Holtz, Goodman, Langer & Chick

[57] ABSTRACT

To provide a sealed through arrangement for electrical leads through a ceramic end plug, suitable for discharge lamps of between about 50 to 250 W power rating, the lead-through (9) is made of a material having a thermal coefficient of expansion which is substantially less than that of a ceramic sealing plug (10), for example of tungsten, molybdenum or rhenium, but so small that the individual, actual expansion of the ceramic material will not cause separation from the metal, and/or a glass melt, ceramic melt or sintar connection therewith. The electrical connection is formed by at least two, and preferably more than two, thin wires or pins (23) having a diameter, each, of up to only about 0.25 mm, and preferably less. Each of the wires, then, will carry currents in the tenths ampere ranges, sufficient for operation of the lamp, and passed through melt-sealed capillary openings in the ceramic sealing plug (10).

20 Claims, 6 Drawing Sheets

HIGH-PRESSURE DISCHARGE LAMP WITH CERAMIC DISCHARGE VESSEL AND CERAMIC SEALING MEANS HAVING LEAD-THROUGH COMPRISING THIN WIRES HAVING A THERMAL COEFFICIENT OF EXPANSION SUBSTANTIALLY LESS THAN THAT OF THE CERAMIC SEALING MEANS

Reference to related applications and patent, assigned to the assignee of the present application, the disclosures of which are hereby incorporated by reference:

U.S. Ser. No. 07/912,526, filed Jul. 13, 1992, now U.S. Pat. No. 5,404,078 Bunk et al PCT/DE 92/00372, filed May 6, 1992, Heider et al, U.S. Ser. No. 08,211,608, filed Apr. 7, 1994, (U.S. designated), published as WO 93/07638

U.S. Pat. No. 5,075,587, Pabst et al.

Reference to related patent, the disclosure of which is hereby incorporated by reference:

U.S. Pat. No. 4,376,905, Kerekes

Reference to related disclosures:

European Patent EP-A 0 142 202, Geijtenbeek

European Published Patent Application EP-A3 0 472 100 A, Weske et al., assigned to the assignee of the present application.

FIELD OF THE INVENTION

The present invention relates to solving a problem when passing an electrical metallic conductor through a ceramic structure, such as a ceramic plate or a terminal portion of a transparent discharge vessel, which is gas and pressure-tight, although the thermal coefficient of expansion of the ceramic element is substantially larger than the thermal coefficient of expansion of the material of the electrical lead.

BACKGROUND

Discharge lamps, and particularly metal-halide discharge lamps and sodium high-pressure discharge lamps frequently use ceramic discharge vessels or arc tubes. Use of ceramics for the arc tube improves the color rendition of the lamp. Typical power ratings of such lamps are in the range of between about 50 to 250 W.

Sodium high-pressure discharge lamps frequently use ceramic discharge vessels or arc tubes made of aluminum oxide, $Al_2O_3$, to which minor amounts of additives of other oxides, particularly MgO can be added. In constructions of this type it has been customary to fit a niobium tube to the ends of the, usually elongated, discharge vessel, to form an electrical connection. The niobium tube is fitted into a plug of ceramic material. Niobium has the specific characteristic that its thermal coefficient of expansion is a good approximation of that of the $Al_2O_3$ ceramic. Both materials have a thermal coefficient of expansion of about $8\times10^{-6}K^{-1}$.

U.S. Pat. No. 4,376,905, Kerekes, describes a high-pressure discharge lamp of relatively high power, for example in the range of about 400 W. The higher power rating of the lamp requires electrical connection into the interior of the arc tube capable of carrying the higher current. To accommodate this higher current, a plurality of niobium wires are used, having diameters of at the most 0.6 mm. Dangerous stresses between the tube and the plug due to heat are thereby avoided.

U.S. Pat. No. 5,075,587, Pabst et al, assigned to the assignee of the present application, and the disclosure of which is hereby incorporated by reference, describes a high-pressure discharge lamp in which the discharge vessel is made of aluminum nitride, AlN. Solid tungsten pins are used to conduct the electrical current. The thermal coefficient of expansion of the tungsten pins or rods is $5\times10^{-6}K^{-1}$, which is a good approximation of that of the AlN. Use of tungsten has the additional advantage that this material is resistant to the highly corrosive effect of metal halides which can be used as a fill in the lamp. Niobium, however, is not resistant to the corrosive effect of a fill in an arc tube.

It has been tried to increase the corrosion resistance even when using niobium in the region of the seal. In metal-halide lamps, having discharge vessels or arc tubes made of $Al_2O_3$, it has been tried to protect the niobium, for example by a recessed fit, or by protective layers, see European Published Patent Application EP-A 0 472 100. This is an expensive way, and difficult to carry out. Use of electrically conductive cermets as end plugs, as described, for example, in European Patent EP-A 0 142 202, does not solve the problem either. The end plugs are more corrosion-resistant than niobium; however, during the operation of the lamp, and due to heating, microfissures occur in the cermet which, conducting electrical energy into the interior of the discharge lamp, acts as an ohmic resistance. These fissures have a tendency to spread and, finally, cause leakage of the originally sealed connection.

THE INVENTION

It is an object to provide a high-pressure discharge lamp or an arc tube therefor, in which the seal of the discharge lamp is improved in the region of the pass-through of an electric current lead, to thereby increase the lifetime of the lamp, and, more in general, to provide a lead-through across a ceramic structure which has a long life, is gas-tight and pressure-tight, and in which the thermal coefficients of expansion of the ceramic and of the material of the electrical lead-through differ substantially.

Briefly, the ceramic element, for example the arc tube of a discharge lamp made of translucent or transparent $Al_2O_3$ ceramic, or another ceramic which is transparent, in which the thermal coefficient of expansion is, similar to $Al_2O_3$, about $8\times10^{-6}K^{-1}$. Other materials than $Al_2O_3$ are, for example, spinel ($MgAl_2O_4$) or yttrium oxide ($Y_2O_3$). The ceramic may be doped with other materials or additives, for example MgO.

Usually, the discharge vessel is elongated, for example cylindrical or bulged centrally to be barrel-shaped; it may, however, also be bent into U shape. The end portions of the ceramic discharge vessel which forms the ceramic structure are closed off with ceramic sealing means, made of a ceramic material which is compatible with, and fits into the end portions of the vessel. The discharge vessel, which has a ceramic structure, and the sealing means need not necessarily be made of the same material; they should, however, be made of materials which have similar thermal coefficients of expansion, matched to each other.

In accordance with a feature of the invention, the electrical conductor or lead-through is made of a metal having a thermal coefficient of expansion which is substantially less than that of the ceramic sealing element, and is formed with at least two, and preferably more than two, thin wires or pins, each having a diameter of up to about only 0.25 mm. Preferably, the electrical wire is made of tungsten or molybdenum or rhenium, or mixtures thereof, that is, of materials which are resistant to the corrosive attack of fills in the arc tube or discharge vessel of a discharge lamp, or to which the lead-through, otherwise, is exposed.

The sealing means or sealing element is usually a separate plug, for example in the form of a cylindrical disk, with a slightly extended edge or a projection, forming a stop when fitting the disk into the discharge vessel, or into a ceramic structure. It need not be a separate plug, however, but may be a suitably shaped integral end region of the discharge vessel, or the ceramic structure as such.

The principle of sealing, in accordance with the present invention, utilizes the advantage of the resistance against corrosion of various metals which, however, have a very low thermal coefficient of expansion, for example about 4 to $5\times10^{-6}K^{-1}$. Tungsten, molybdenum, rhenium and alloys thereof have these characteristics. They have been found to be particularly suitable when combined with ceramic materials, used as discharge vessels for high-pressure discharge lamps, particularly $Al_2O_3$. The quality of the seal, primarily, depends on the material of the sealing element or sealing means, which is usually an end plug, since this is the only element which directly comes in contact with the electrical conductors. Secondarily, the material of the discharge vessel itself is also of importance.

The same considerations apply also in the case when the sealing means or sealing element is a multiple-part structure in which only one of them is in direct contact with the electrical lead-through.

The present invention is based on the consideration that it is not possible to reliably over a long period of time connect two materials of differing thermal coefficients of expansion in a vacuum-tight sealed manner, when the structure is subject to substantial variations in temperature, between ambient and up to, for example, 800° C. to 1000°. Such variations arise in operation of a discharge lamp. Comparing the thermal coefficients of expansion, however, only gives data for the relative differences in expansion. A second parameter, which is of equal significance, is the absolute value of the differences in expansion upon change in temperature. Thus, if the dimension of one of the elements to be sealed into another are very small, the actual differences in expansion are so small that they can be neglected.

The general principle of the foregoing is found in discharge vessels made of quartz glass. Extremely thin foils of molybdenum are used to carry electrical current through quartz-glass seals. It has been found—surprisingly—that in ceramics the same principle can be used if the electrical element passing current through the ceramic sealing means utilizes a commercial wire or pin having a diameter of at most 0.25 mm as a basis. Preferably, the diameter should be substantially less, and it has been found that diameters between about 0.05 and 0.13 mm are preferred.

Lamps of various and higher power ratings require electrical connections of greater cross-sectional area. Higher current capacity can be obtained, in accordance with a feature of the present invention, by increasing the effective cross-sectional area of the lead-through by connecting a plurality of wires in parallel, and locating them, preferably, parallel to each other. Higher power ratings may use up to 9, or even more wires connected in parallel. This has additional and surprising side effects. If two or more than two parallel wires are used, the lead-through is mechanically more stable. It is possible to twist together the portions of the wires which extend into the interior of the discharge vessel to a twisted, multi-strand wire or cable.

Twisted multi-strand wires in the interior of low power lamps have another advantage, namely that the ends of the twisted wires can be melted together to form an electrode tip of high heat capacity. An essentially spherical end cap or dome can thus be formed. Such a lead-through is particularly suitable when using tungsten as the wire material, since it is particularly heat-resistant. This permits elimination of a separate electrode which must be connected to the lead-through in an expensive and complex manner. This connection thus can be eliminated. The diameter of the melted-back end ball or end dome of such an electrode tip can readily be controlled by controlling the length of an arc which melts back the portions of the twisted wires; the arc can be generated by a plasma burner or a laser.

In the simplest case it is sufficient to conduct a bundle of wires which optionally can be loosely twisted through a single, tightly fitted bore within the sealing element, and to seal this bore by a glass melt to be vacuum-tight. Alternatively, single wires or separate twisted wires can be passed through two, or more than two tightly fitting bores. The sealing effect is given for the individual wires by the glass melt, which surrounds the individual wires. If a plurality of wires, which may be loosely twisted, are located in a bore, the capillary effect of the spaces between the wires ensures appropriate penetration and surrounding of the wires with a glass melt. The use of bundled or loosely twisted wires has a manufacturing advantage, namely the threading of the wires through the bores is simpler and faster.

When making the sealing element, it is important to make the bore, normally, so small that a ball tip at the electrode cannot pass therethrough. Thus, preferably first a loosely twisted bundle of wires is passed through the respective bore of the end plug or end element of the ceramic, and sealed by a glass melt seal. Thereafter, and for example by passing excess current therethrough, the ball is formed at the tip of the electrodes. The vessel can be filled, for example, by forming a lateral bore in the wall of the discharge vessel.

The bundle of wires, in an alternative form, may be inserted initially through the bore of an end plug before the end plug is fitted into the bulb. The electrode tip is then formed, or secured to the bundle of wires. The discharge vessel is then filled with its fill, and such additives as may be introduced through the upper end thereof. The subassembly of end plug, bundle of wires and electrode tip is then fitted into the still open end, and the gap between the end of the discharge vessel and the plug, as well as the bore which contains the bundle of wires within the plug, is then closed off by a melt seal, for example by a glass melt or glass solder. This technology can also be used when the end plug has a plurality of bores for individual strands of wires or for a plurality of strands, one or more in each of a plurality of bores.

In another form, the individual wires in individual bores, or small bundles of wires in individual bores, can be sealed into the end plug before the end plug is introduced into the vessel. This technology is particularly suitable if the diameter of the wires is small; as the wire diameter decreases, this technology is of increasing importance.

The wires can be sealed in the separate bores by direct sintering. After sealing the wires in the bores, the electrode tip is then formed by first twisting together the individual wires to a multi-strand unit, and forming a ball tip or the like, or securing an electrode tip thereto. This subassembly can then be introduced, as above described, in the second still open end of the discharge vessel, after it has been filled, and any filling steps have been terminated. The ring gap between the end plug and the end of the discharge vessel is finally closed by a glass melt. This technology utilizes a minimum of glass melt, so that the corrosive effect of the fill on the glass melt can be practically neglected. In any case, it is recommended to utilize a glass melt which is as resistant to halides as possible.

Direct sintering of the end plug into the end of the discharge vessel and simultaneously directly sintering the lead-through wires or strands in the end plugs is also possible. This, however, again requires a lateral opening in the wall of the discharge vessel to introduce the fill.

The technology permits introduction of a plurality of wires through a separate bore, particularly if a special material having a reduced coefficient of expansion is used as a sealing means.

Forming the sealing means of a plurality of parts is particularly suitable and preferred from a manufacturing or processing point of view. This is particularly important if the seal can be made of an engaging or contacting central portion and the peripheral portion surrounding the central portion or part. This arrangement has advantages upon introduction of the lead-through, as well as in sealing and, further, upon formation of a twisted wire formed of individual strands. Preferably, the central portion can be formed as a multiple capillary unit, in which each strand element is individually threaded through one of the capillary bores. A separate central portion simplifies handling upon threading the wires. The wires are then twisted together in the region of the electrode tip. This twisting can be done, preferably, after the wires have been threaded through the bores. The electrode tip; for example a melted-back ball, is also made only after threading the wires and twisting them. This arrangement has the particular advantage that the seal between the lead-through and the central portion can be made before the central portion is introduced into the end of the discharge vessel. Thus, and particularly in direct sintering, that is, operating without a glass melt, the necessary temperature required for sintering can thus be used without regard to the temperature to which, otherwise, the entire discharge vessel would be exposed. Thus, temperatures which otherwise would deleteriously affect a fill in the discharge vessel can be used, apart therefrom.

Use of a separate central portion, particularly with multiple capillary openings, forms a simple solution for the problem of filling of the discharge vessel. The bore which is to receive the central portion can be used initially as a fill opening in the end region of the vessel. In such constructions, a first end of the discharge vessel is first completely closed; the second end is left open to form a fill opening, to be closed only after evacuating and introducing the fill. Alternatively, a multiple opening capillary central plug may be used in which one or more openings are not occupied by wires so that these openings can then be used as fill openings.

Details with respect to the technology of direct sintering and filling processes by use of an opening which is closed later are described in the referenced U.S. Ser. No. 07/912,526 and in the international application PCT/DE 92/00372, U.S. designated, U.S. Ser. No. 08/211,608, filed Apr. 17, 1994, Heider et al, published as WO 93/07638, both assigned to the assignee of the present application, the disclosure of which is hereby specifically incorporated by reference.

The arrangement has a particular advantage when used in metal halide discharge lamps having ceramic discharge vessels. The lifetime of such lamps, up to now, was limited due to the aggressive and corrosive action of the fill within the discharge vessel. The lead-throughs made of tungsten or molybdenum have been found to be particularly suitable, since they have a high degree of resistance against corrosion.

DRAWINGS

Figure 1:
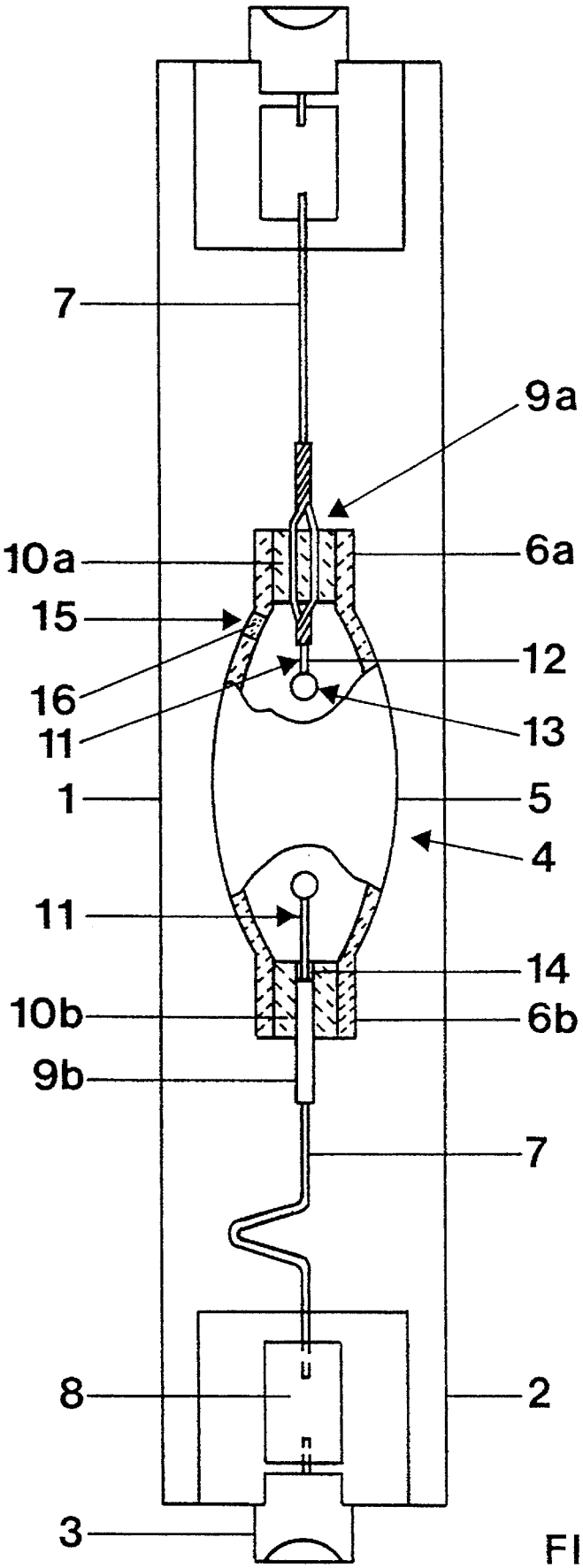
FIG. 1 is a highly schematic side view, partly broken away and in section, of a metal halide discharge lamp, and utilizing a lead-through in accordance with the present invention.
Figure 2:
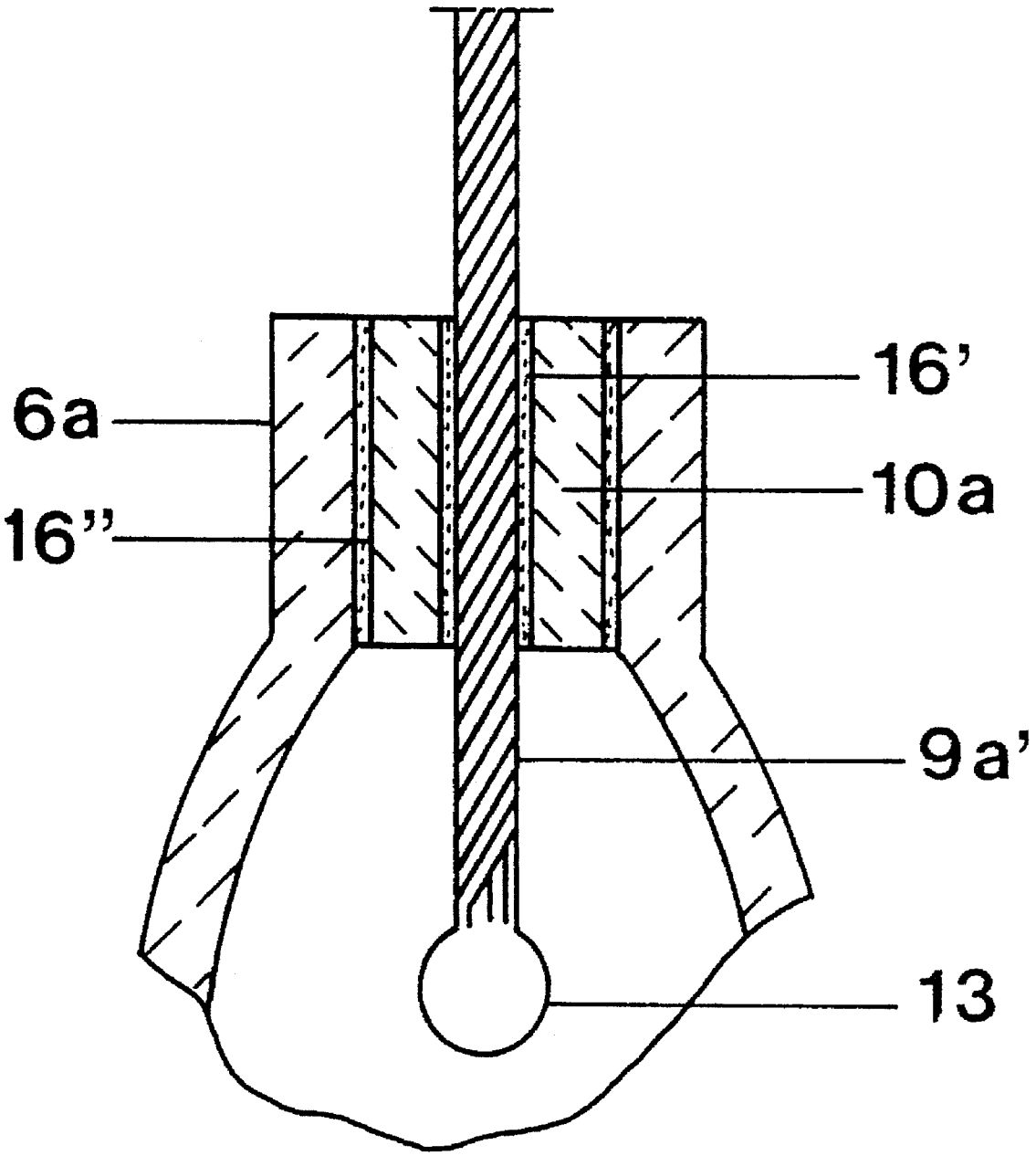
FIG. 2 is a detail enlarged view of an end portion of the discharge vessel.
Figure 3A:
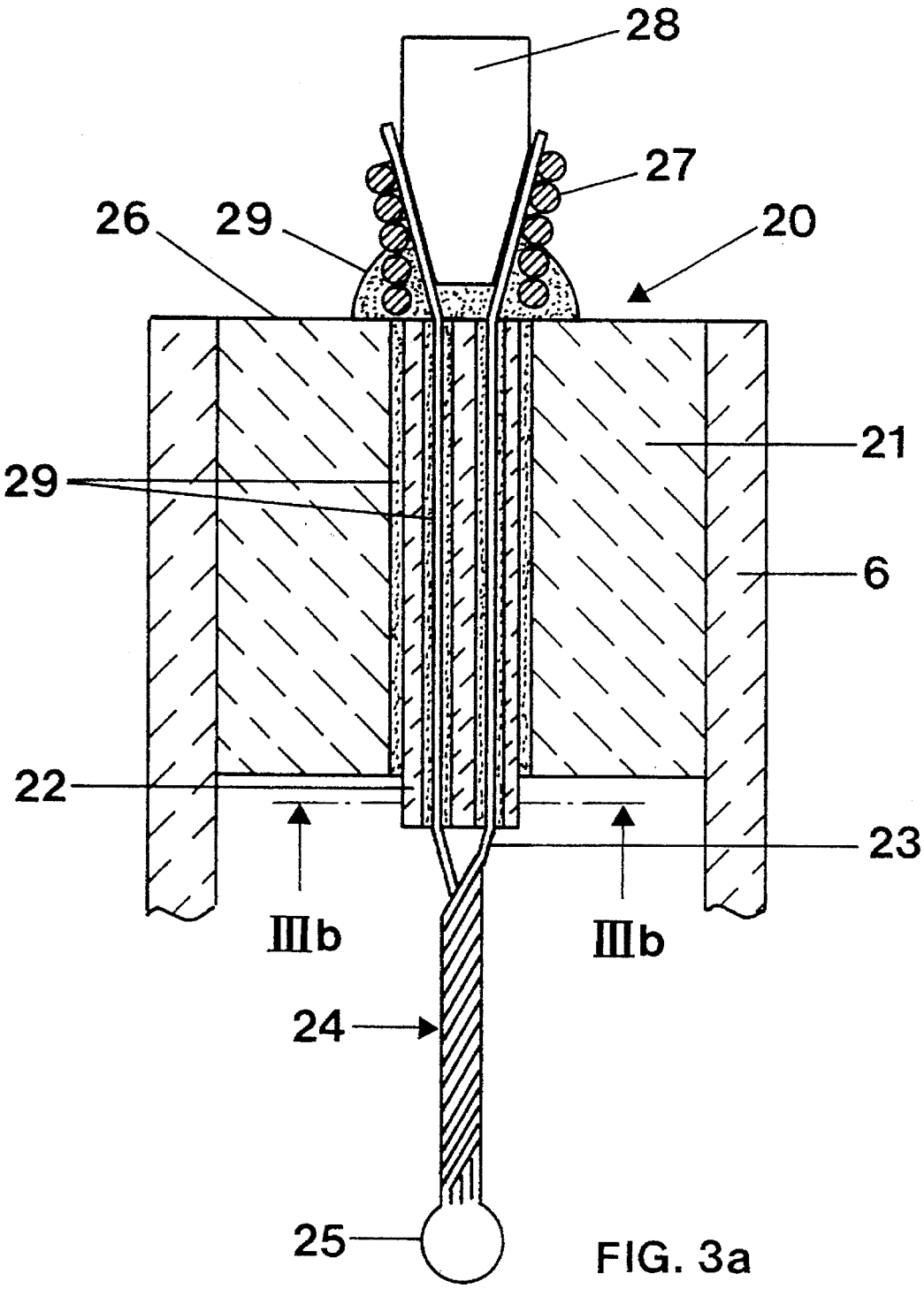
Figure 3B:
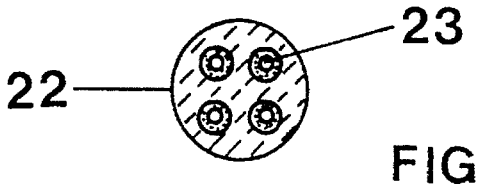
Figure 3C:
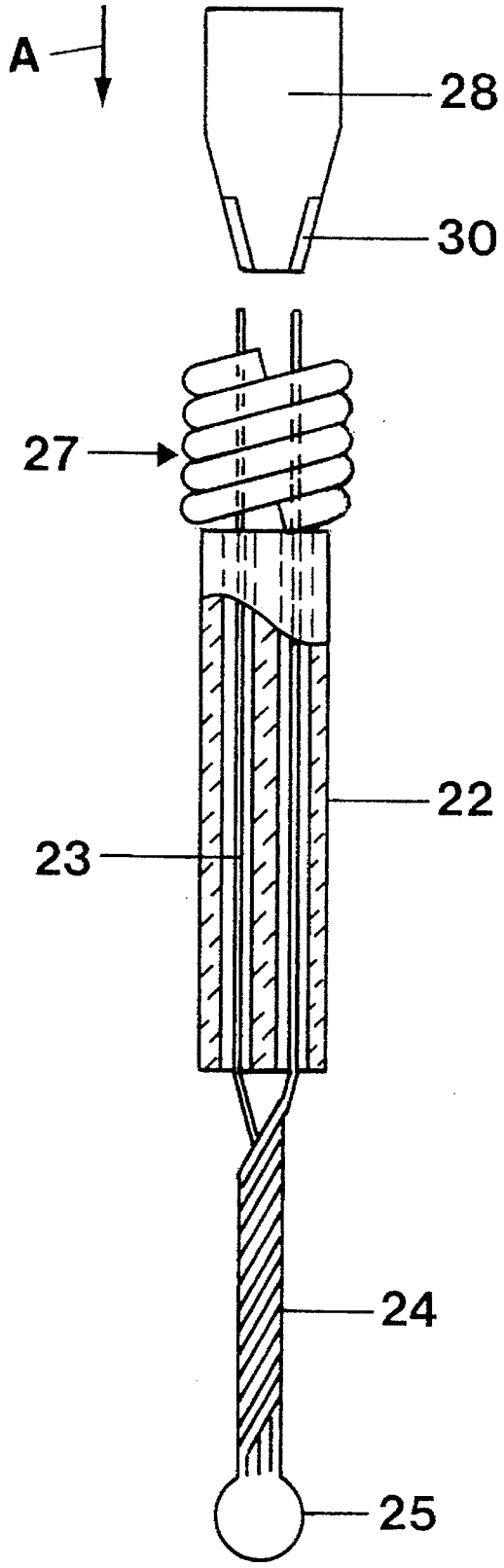
Figure 3D:
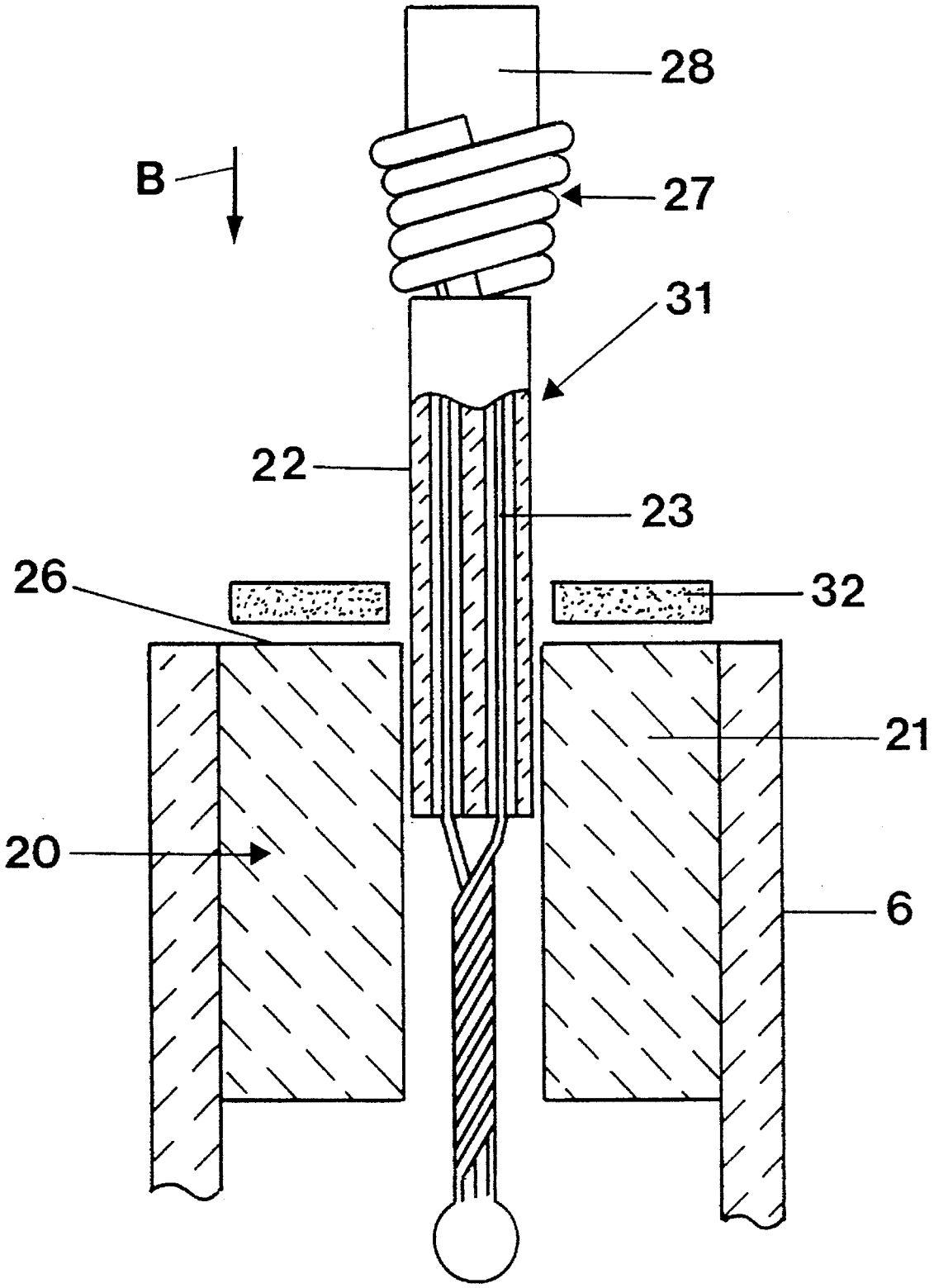
Figure 4A:
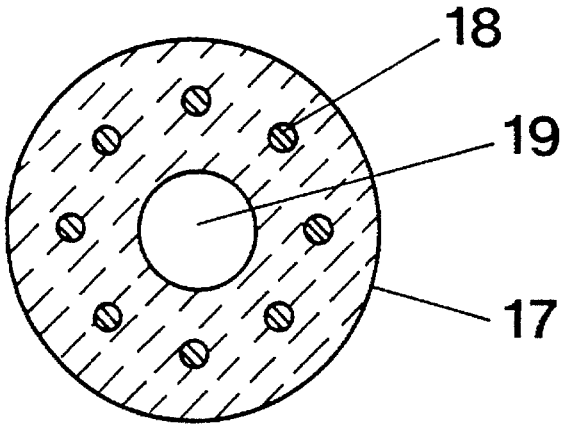
Figure 4B:
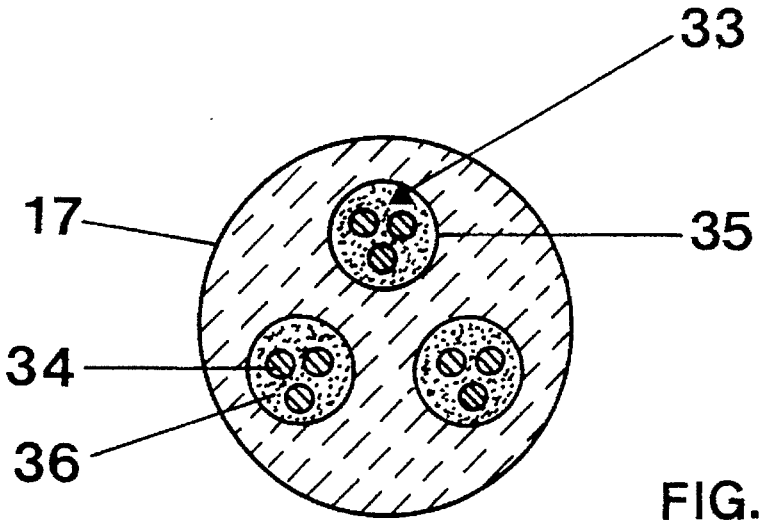
Figure 4C:
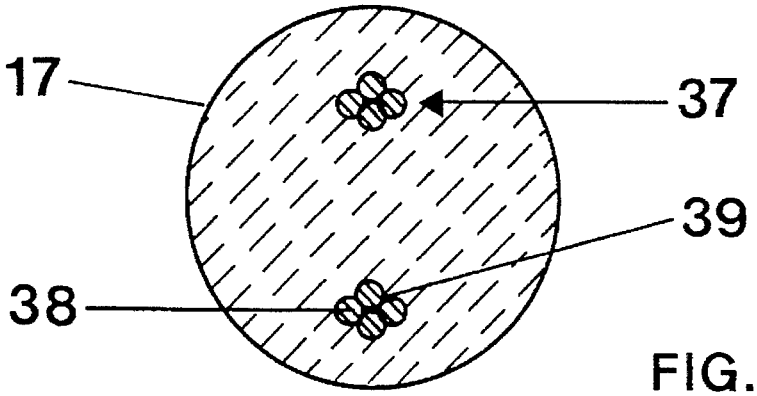

FIG. 3*a* is a view similar to FIG. 2, illustrating another embodiment, and to a still greater scale;

FIG. 3*b* is a cross section taken along line III*b*–III*b*, and omitting the end plug for clarity;

FIGS. 3*c* and 3*d* show, in schematic and part-sectional representation, steps used in making the lead-through illustrated in FIGS. 3*a* and 3*b;* and FIGS. 4*a*, 4*b* and 4*c* are cross sections similar to the cross-sectional view of FIG. 3*b*, and illustrating other embodiments of arrangements of wires in a lead-through for the lamp of FIG. 1.

DETAILED DESCRIPTION

For purposes of illustration, a metal halide discharge lamp of a power rating of 100 W will be described. The lamp, see FIG. 1, has a cylindrical outer envelope 1 of quartz glass which is pinch-sealed at two ends by pinch seals 2, and supplied with bases 3 at the respective ends. A discharge vessel or arc tube 4 of $Al_2O_3$ ceramic is located within the outer envelope 1. The discharge vessel 4 is bulged outwardly in the center region 5, and has cylindrical ends 6*a*, 6*b*. The shape of the discharge vessel itself is not critical; it may also be made of a cylindrical tube. Two current supply leads 7, coupled to the bases 3 via foils 8 retain the discharge vessel within the outer envelope 1. The current supply leads 7 are made of molybdenum and are welded to lead-throughs 9*a*, 9*b*. Each lead-through is directly sintered into a ceramic end plug 10*a*, 10*b*, respectively, fitted in the ends of the arc tube 5. Sintering the lead-throughs directly eliminates glass melts. The end plugs 10*a*, 10*b* are also made of $Al_2O_3$ ceramic. The discharge vessel 4 retains a fill which includes an inert ignition gas, for example argon, mercury and metal halide additives.

The first lead-through 9*a* is located at a first end 6*a* which forms the pump end, used when filling the lamp.

In accordance with a feature of the invention, the lead-through 9*a* is formed of two molybdenum wires of 0.22 mm diameter each, which are passed through the end plug 10a through two spaced bores. The two wires retain an electrode 11 within the interior of the discharge vessel 4. The electrode 11 is made of an electrode shaft 12 of tungsten and a tip 13 which is essentially spherical or ball-shaped.

The second lead-through 9*b* is located at the second end 6*b* of the arc tube 4 which will be referred to as a blind end. It is made of a solid niobium pin which is fitted in the bore of the end plug 10*b*, with a recess, as shown at 14. A fill bore 15 is located in the side of the vessel in the vicinity of the pump end 6*a* which, after introducing the fill into the vessel, is closed off by a glass melt or glass solder or a melt ceramic 16.

In this embodiment of the lamp, the operating position of the lamp becomes material in order to hold corrosion to a minimum, even though one niobium lead-through arrangement is used.

In accordance with another embodiment of the invention, both ends 6a and 6b use the same multi-wire lead-through arrangement described with respect to the end 6a. In such an arrangement, the operating position of the lamp becomes immaterial.

Embodiment of FIG. 2

The ceramic end plug 10a has a single bore. A continuous, loosely twisted lead-through 9a' is guided through the bore in the ceramic end plug 10a. The lead-through 9a' is made of four single wires which are melted together to a ball 13 at the inner tip thereof. The lead-through 9a' is melt-sealed in the bore by a glass melt 16'. The end plug 10a, in turn, is melt-sealed in the end 6a of the discharge vessel by a glass melt 16". A separate fill bore in the side wall, as illustrated in FIG. 1, is not necessary since the end plug 10a can be inserted only after evacuation and filling of the discharge vessel through the pump end 6a.

Embodiment of FIG. 3 (Collectively)

FIG. 3a illustrates a portion of the lead-through and current connection to the interior of the lamp, and showing any one of the end portions, here generically end portion 6 of the arc tube or discharge vessel.

The ceramic end plug 20 is made of two concentrical parts, namely an outer or peripheral part 21, which is in ring shape, and an inner or central portion 22. The inner central portion 22 is formed as a cylindrical quadro-opening capillary plug having an outer diameter of about 1.2 mm. Both parts of the plug 20 are made of $Al_2O_3$ essentially. The inner diameters of the capillaries formed by the four bores of the inner part are about 0.2 mm. Each capillary opening has a tungsten wire 23 of 0.1 mm diameter threaded therethrough. The tungsten wires 23 are twisted together to a stranded conductor 24 which is melted together at its end to a ball 25 of about 0.70 mm diameter. This type of lead-through is suitable for currents of up to about 1.2 A. FIG. 3b illustrates a top view of the capillary 22 with the wires 23 therein, omitting parts not necessary for an understanding of the view.

The wires 23 are surrounded by a spiral 27 of niobium at the outside 26 of the end plug 21. A conical closing portion 28 of niobium is fitted into the spiral 27 in such a manner that the wires 23 are clamped at the inside of the spiral 27. The central portion 22 is sealed liberally by glass melts 29 in the peripheral portion 21, which simultaneously also seals the wires 23 within the bores of the central part 22 by the glass melt 29. The niobium spiral 27, likewise, is secured to the outside 26 of the end plug by the glass melt 29.

Manufacture and Sealing of the End of the Discharge Vessel, with Reference to FIGS. 3c and 3d:

First, wires 23 are threaded into the bores of the inner capillary part 22, and twisted together to form the stranded conductor 24. The electrode tip 25 is then formed by melt-back of the conductors. Next, the niobium spiral 27 is fitted over the ends 23 at the remote or distal end of the capillary, that is, the end remote from the interior of the discharge vessel. The ends 23 are then clamped within the spiral 27 by introducing the conical closing portion 28, which is introduced, as shown in FIG. 3c, schematically, by the arrow A. This somewhat spreads apart the spiral or winding 27. Improved guidance of the wires can be obtained by forming the element 28 with grooves or depressions 30 in the conical surface, to locate the wires 23.

The electrode system 31, now forming a subassembly (see FIG. 3d), including the inner capillary part 22, is inserted in the central bore of the peripheral part 21, already secured in the end of the discharge vessel, as schematically shown by the arrow B. Preferably, the niobium winding or spiral 27 projects slightly laterally over the capillary tube 22, to form a stop for the electrode system 31, and to provide for positioning before melting it in the central bore of the peripheral plug element. A ring 32 of glass melt material is placed on the outer surface 26 of the end plug 20, and the end 6 is locally heated until the glass melt 32 melts and runs into any hollow spaces or voids, thereby sealing the bores of the end plug, positioning and securely fixing the spiral 27 (see FIG. 3a). The spiral 27 must be made of a metal which has a thermal coefficient of expansion similar to niobium, for example tantalum, or of niobium itself, since, otherwise, connection with a glass melt which will be free of fissures or cracks cannot be ensured.

FIG. 4, collectively, illustrates cross-sectional views of other embodiments suitable for the general construction illustrated in FIG. 3 (collectively). FIG. 4a illustrates a multiple-opening capillary tube 17 suitable, for example, for a 150 W lamp. The current needed for such a lamp, approximately 1.8 A, requires eight wires 18, which are directly sintered within eight bores of the element 17. The capillary tube 17 is formed with a large central bore 19 which can be used to fill the discharge vessel. In this embodiment, a separate filling bore in the wall of the discharge vessel, as illustrated in connection with FIG. 1, see fill bore 15, can be eliminated. Bore 19, after filling, is closed off by a glass melt or by a melt ceramic.

FIG. 4b illustrates an arrangement in which bundles 33 of three wires 34, each, are located in the openings of the capillary tube 17. The wires 34 are not twisted together and are spaced from each other. The three bores 35 are sealed and closed off by glass melt 36 to be vacuum-tight; each one of the separate wires 34 is surrounded by a glass melt 36.

FIG. 4c illustrates an arrangement in which bundled wires 37, each including four wires 38, are located in respective bores 39 of the capillary 17, and directly sintered therein. This is possible only by using special arrangements, since the thermal coefficient expansion of the end plug, and particularly the central portion 17, must be better matched to that of the metal lead-throughs. For such an arrangement, the end plug, or at least the capillaries, preferably is made of a ceramic base material, such as $Al_2O_3$, which has additives, for example up to about 40% of a metal, typically of tungsten. Due to the relatively small differences in actual expansion, under heating, it is possible to locate a plurality of wires 38 directly adjacent each other, in a bore 39. Preferably, the bore 39 then has a cross section which is matched to that of the bundle of wires 38. The wires, preferably, are located in a four-leaf clover arrangement, as illustrated in FIG. 4c.

Various changes and modifications may be made. In accordance with a preferred arrangement, the capillary tube 17 slightly extends beyond the end of the end plug 21 within the interior of the discharge vessel. It has been found that this improves the ignition and operating conditions of the lamp. Any condensate of fill materials will then wet only the projecting collar of the capillaries, but not the lead-throughs. This projection is clearly seen in FIG. 3a.

The current through the individual wires is, preferably, in the range of between about 0.1 to 3 A. The starting current, which is higher, will extend for a very short period of time, which is insufficiently long to cause problems, since the total energy (power×time) through the wires will be insufficient to also cause undue heating of the adjacent ceramic or glass melt materials.

Various other changes and modifications may be made, and any features described herein in connection with any one of the embodiments may be used with any of the others, within the scope of the inventive concept.

We claim:

1. High-pressure discharge lamp having a sealed discharge vessel (4) of translucent ceramic, and having two integral ceramic end portions (6*a*, 6*b*);

ceramic means (10) for sealing the end portions;

an electrical lead-through (9) gas-tightly passing through at least one of the ceramic sealing means (10);

an electrode (11) located inside the discharge vessel, electrically and mechanically secured to the lead-through; and a light-emitting fill within the discharge vessel (4), wherein, in accordance with the invention, the ceramic sealing means (10) comprises at least one of the materials of the group consisting of: $Al_{2O3}$, $Y_2O_3$, $MgAl_2O_4$, or a mixture of any two, or all of the foregoing materials; and the electrical lead-through comprises at least two, and optionally more than two, thin wires or pins (23), each having a diameter of up to about 0.25 mm and consisting of a metal having a thermal coefficient of expansion which is substantially less than that of the ceramic sealing means (10).

2. The lamp of claim 1, wherein said ceramic sealing means (10) consists essentially of at least one of the materials of the group consisting of: $Al_2O_3$, $Y_2O_3$, $MgAl_2O_4$, or a mixture of any two, or all of the foregoing materials.

3. The lamp of claim 1, wherein the lead-through (9) metal comprises tungsten or molybdenum or rhenium, or a mixture of the foregoing.

4. The lamp of claim 1, wherein (FIG. 3*b*) the sealing means (10) is formed with at least two bores, and said thin wires (23) are located, one each, in a respective bore of the sealing means (10).

5. The lamp of claim 1, wherein the at least two wires, and optionally more than two wires, are twisted together within the discharge vessel to form a stranded wire (24).

6. The lamp of claim 5, wherein the end portions of the stranded wire (24) are melted together to form an electrode tip (25) having high heat capacity.

7. The lamp of claim 1, wherein (FIG. 3) the lead-through (9) is sealed in the sealing means by, optionally, a glass melt (29) or by being directly sintered in the sealing means.

8. The lamp of claim 1, wherein (FIG. 3*a*) said sealing means comprises a multiple-part structure (20) having a tubular, individual, separate part (22) receiving said lead-through (9).

9. The lamp of claim 8, wherein said separate part comprises a capillary element (22) having a plurality of bores passing essentially axially therethrough.

10. The lamp of claim 1, further including means (20) for sealing the ends of said wires (23) outside of the vessel, said means comprising a resilient, essentially circular element (27);

an electrically conductive closing element (28) having an at least part-conical surface, fitted into said resilient element (27), so that the outer ends of said wires are mechanically clamped between the resilient element (27) and said closing element (28) to form an electrically conductive and mechanically secure connection between the lead-through and said closing element.

11. The lamp of claim 10, wherein at least the resilient element (27) is made of niobium or tantalum.

12. The lamp of claim 10, wherein the resilient element comprises a spiral spring (27).

13. The lamp of claim 1, wherein said light-emitting fill within the discharge vessel includes metal halides.

14. The lamp of claim 1, wherein the sealing means (10), or at least part thereof, includes ceramic with up to about 40% non-ceramic additives.

15. A sealed lead-through arrangement for gas-tightly and pressure-tightly passing an electrical lead-through (9) through a ceramic element (4) and having a ceramic means (10) for sealing said pressure to the lead-through (9), wherein, in accordance with the invention, the ceramic sealing means (10) comprises:

at least one of the materials of the group consisting of: $Al_2O_3$, $Y_2O_3$, $MgAl_2O_4$, or a mixture of any two, or all of the foregoing materials; and the electrical lead-through comprises at least two, and optionally more than two, thin wires or pins (23), each having a diameter of up to about 0.25 mm and consisting of a metal having a thermal coefficient of expansion which is substantially less than that of the ceramic sealing means (10).

16. The arrangement of claim 15, wherein said ceramic sealing means (10) consists essentially of at least one of the materials of the group consisting of: $Al_2O_3$, $Y_2O_3$, $MgAl_2O_4$, or a mixture of any two, or all of the foregoing materials.

17. The arrangement of claim 15, wherein the lead-through (9) comprises tungsten or molybdenum or rhenium, or a mixture of the foregoing.

18. The arrangement of claim 15, wherein (FIG. 3*b*) the sealing means (10) is formed with at least two bores, and said thin wires (23) are located, one each, in a respective bore of the sealing means (10).

19. The arrangement of claim 15, wherein the at least two wires, and optionally more than two wires, are twisted together outside of the sealing means (10) to form a stranded wire (24).

20. The arrangement of claim 15, further including means (20) for sealing the ends of said wires (23) outside of the sealing means, said means comprising a resilient, essentially circular element (27);

an electrically conductive closing element (28) having an at least part-conical surface, fitted into said resilient element (27), so that the outer ends of said wires are mechanically clamped between the resilient element (27) and said closing element (28) to form an electrically conductive and mechanically secure connection between the lead-through and said closing element, said resilient element (27) optionally being made of niobium or tantalum and forming a spiral spring (27).

* * * * *